US005549209A

United States Patent [19]

Weissman et al.

[11] Patent Number: 5,549,209

[45] Date of Patent: Aug. 27, 1996

[54] CLOSURE BRUSH

[75] Inventors: Neal V. Weissman, New York, N.Y.; James C. McKinney, Cranbury, N.J.

[73] Assignee: Colgate-Palmolive Company, New York, N.Y.

[21] Appl. No.: 398,322

[22] Filed: Mar. 3, 1995

[51] Int. Cl.[6] ..... A46B 11/00; B65D 23/12

[52] U.S. Cl. ..... 215/228; 215/386; 220/212; 220/736; 401/129

[58] Field of Search ..... 215/44, 228, 386, 215/390, 391; 220/694, 697, 735, 736, 212; 401/126, 129; 15/257.05

[56] References Cited

U.S. PATENT DOCUMENTS

| | | | |
|---|---|---|---|
| 586,283 | 7/1897 | Cole . | |
| 2,248,011 | 7/1941 | Neuschaefer | 401/129 |
| 2,582,721 | 1/1952 | Roshkind | 215/228 X |
| 2,633,845 | 4/1953 | Peretti | 401/129 |
| 2,639,658 | 5/1953 | Biehls . | |
| 2,990,076 | 6/1961 | Stull | 401/129 X |
| 3,684,387 | 8/1972 | Glenn | 15/257.05 |
| 4,690,579 | 9/1987 | Tuckman | 401/129 X |
| 4,712,936 | 12/1987 | Kessler | 401/126 X |
| 4,733,788 | 3/1988 | D'Amico | 401/129 X |
| 4,756,857 | 7/1988 | Dezio et al. | 215/44 X |
| 4,773,560 | 9/1988 | Kihscher | 215/228 X |
| 4,917,268 | 4/1990 | Campbell et al. . | |
| 5,188,472 | 2/1993 | Sgro | 401/129 X |

FOREIGN PATENT DOCUMENTS

| | | | |
|---|---|---|---|
| 369560 | 5/1990 | European Pat. Off. | 215/228 |

*Primary Examiner*—Allan N. Shoap
*Assistant Examiner*—Nathan Newhouse
*Attorney, Agent, or Firm*—Michael J. McGreal

[57] ABSTRACT

The present closure is a measuring cup closure for a bottle which has bristles on the lower peripheral edge of the measuring cup portion. The closure can have a skirt disposed outwardly from the measuring cup portion, with this skirt having threads to attach the closure to the exterior threads on a bottle. In the alternative, the measuring cup portion can have threads to mate with threads on the inner surface of the bottle. There is at least a portion of the lower peripheral edge of the measuring cup that is free of bristles.

22 Claims, 5 Drawing Sheets

CLOSURE BRUSH

FIELD OF THE INVENTION

This invention relates to a closure which is a measuring cup and which also has brush bristles depending from a lower surface. More particularly, this invention relates to a closure for a detergent bottle where the closure is a measuring cup and a brush.

BACKGROUND OF THE INVENTION

Measuring cup closures are well known in the art. They are broadly used on liquid laundry detergent bottles. These measuring cup closures have a volume in many instances sufficient for a normal load of wash. Larger loads may require two doses. However, there is the convenience that when a supply of liquid detergent is purchased, there will be an accompanying measuring cup which will be part of the closure. The consumer need not retain a measuring cup for this purpose. However, it is not known to provide such a closure with bristles depending from a lower surface so that the closure besides being usable as a measuring cup also can be used as an applicator for detergent used as a pre-spot substance.

In the prior art, there are shown measuring cup closures and the combination of brush bristles as a part of a closure. These will be depending downward from the inner surface of the closure but there are no disclosures of measuring cup closures which also contain bristles. Illustrative of measuring cup closures are U.S. Pat. No. 4,917,268 and U.S. Pat. No. 4,773,560. Each of these patents discloses a closure for a detergent bottle which also is a measuring cup. U.S. Pat. No. 586,283; 2,633,845 and 2,639,658 disclose the state-of-the-art where a brush depends from the inner surface of a closure. In U.S. Pat. No. 586,283, the cap B has as a part the brush handle $b^3$ which has brush bristles $_b$4 on the lower end. The brush bristles will apply the substance from tube A. In U.S. Pat. No. 2,633,845, there is disclosed a closure with conical bristles formed on this closure. The conical bristles can be of the same or varying stiffness. U.S. Pat. No. 2,639,658 discloses a closure for a butter container where the closure carries a bristle retaining insert. This bristle retaining insert is removable from the closure for cleaning or replacement.

There are containers where a brush application is on the exterior surface of a closure. In such an instance the brush would have to be washed and dried prior to putting it back onto the closure. If the brush is not washed and dried the closure and bottle will become coated with the product in the container. It is shown by the prior art that it has been known to use a measuring cup as a closure. Also, it is known to have brush bristles on the inner surface of a closure. However, it is not known to use the closure of a bottle, and in particular a detergent bottle, as a measuring cup and also as a brush by having bristles depending from the edge of the open end of the measuring cup. This is very useful since new liquid detergents have a concentration about that of pre-spot compositions. By having the closure of a new super concentrated detergent function as the measuring cup for dosing the detergent and as the brush for applying the detergent to a spot, there is an increased utility of the closure.

BRIEF SUMMARY OF THE INVENTION

The present discovery is a closure for a bottle, such as a detergent bottle, where the closure is a measuring cup which has bristles depending from its lower peripheral surface.

With the bristles depending from the peripheral edge of the measuring cup of the closure, the closure, besides being used as a doser, can be used as the applicator for the use of the detergent for pre-spotting a fabric.

The closure is comprised of an upper surface which has depending therefrom a peripheral skirt to form a cup shape. Adjacent the lower end of the peripheral skirt there can be a second skirt, spaced from the peripheral skirt, this second skirt having internal threads to attach to external threads on the exit of a bottle. When the closure is to attach to internal threads on a bottle, the exterior lower surface of the peripheral skirt will have an increased structural integrity and will have threads on the exterior surface. These exterior threads will engage the threads on the interior of a bottle exit. Carried on at least a portion of the peripheral surface of the edge of the peripheral skirt are bristles. When the closure is fastened onto the bottle, the bristles are contained within the exit opening of the bottle and any product on the bristles can drain back into the bottle.

In use to apply a cleaning substance to a fabric, the closure is removed from the bottle and a small quantity of liquid poured into the measuring cup portion of the closure. This liquid then is poured onto part of the fabric or other item to be cleaned. When this is done, the closure is inverted and the depending peripheral bristles are used to work the liquid into the fabric or other material. After the article of clothing or other material is scrubbed the wet brush is then returned onto the bottle without the need to wash and dry the brush. The user never need to touch the cleaning product as any product on the brush will drain back into the bottle.

DETAILED DESCRIPTION OF THE INVENTION

Broadly, the present invention is directed to a measuring cup closure that has bristles on a lower peripheral edge. This is a closure for a bottle. The bristles on the closure fit within the exit of the bottle when the closure is fitted onto the bottle. This measuring cup with bristles is very useful with the new laundry detergents which have a concentrated composition which is about that of the commercially available pre-spot products. This closure makes the use of a concentrated detergent more useful as a pre-spot since the bristles on the closure can be used to work the detergent into the soil in the fabric. In addition the closure remains a no-drip closure with any liquid on the bristles draining back into the container.

Figure 1:
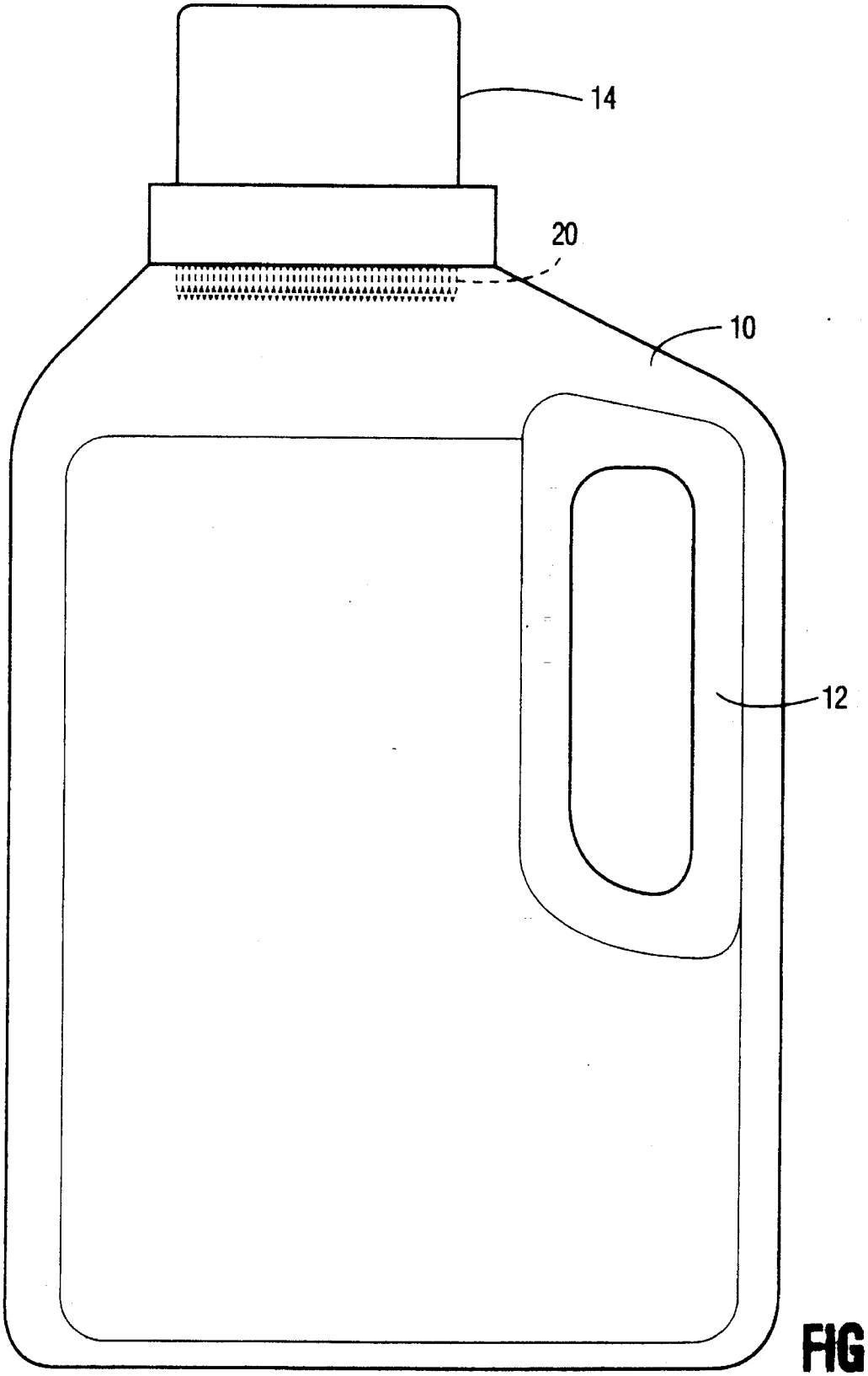
FIG. 1 shows a bottle with the present closure in place.
Figure 2:
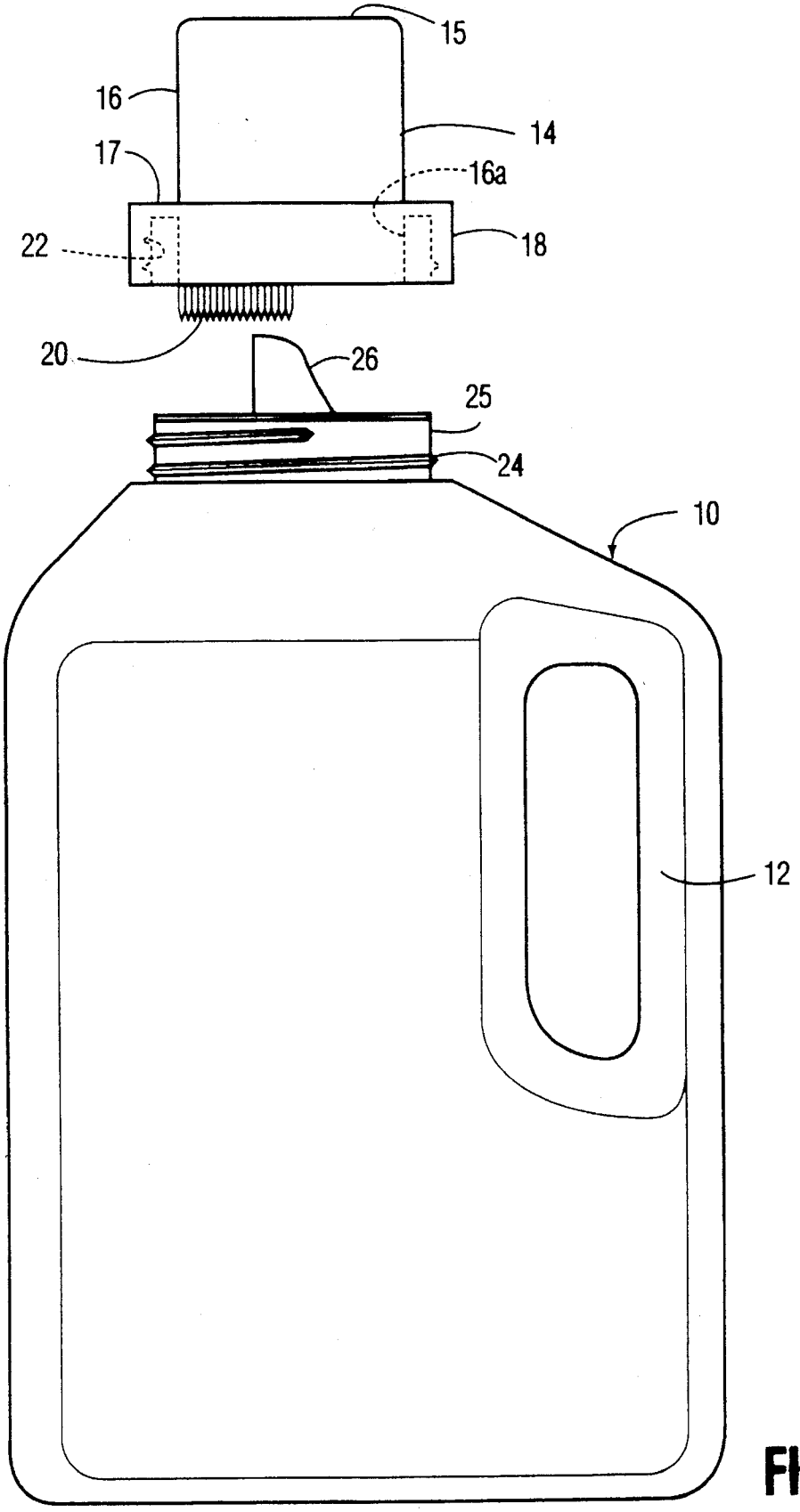
FIG. 2 shows the closure removed from the bottle

The present closure is shown in FIG. 1 used with a bottle 10. Such a bottle will have a handle 12 and have a closure 14 attached to the upper exit of the bottle. In FIG. 2, this bottle is shown with the closure removed. This shows additional structure of the bottle and closure. The bottle is shown with exit 25 and pour spout 26. Threads 24 of the bottle engage threads 22 of the closure to fasten the closure to the bottle. The closure has upper surface 15 and a first skirt 16. This first skirt along with the upper surface forms the measuring cup. Depending from the first skirt is a second skirt 18. Ledge 17 connects the second skirt to the first skirt. On a lower part 16(*a*) of the first skirt 16 are bristles 20. The lower part 16(*a*) of the first skirt is the part of the first skirt below ledge 17 and which is within second skirt 18.

Figure 3:
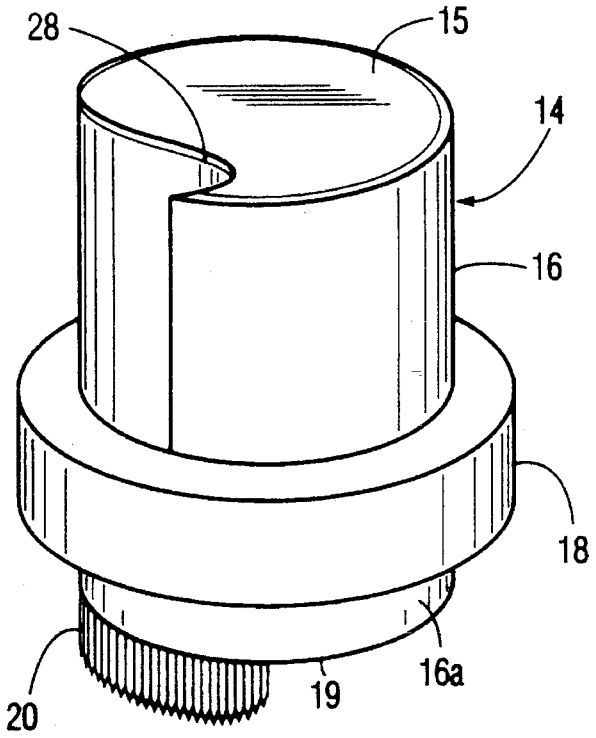
FIG. 3 shows a perspective view of the closure with a recess grip feature.

FIG. 3 is a perspective view of the closure with a grip built into the first skirt 16. The grip consists of recess 28 in the surface of the first skirt. This will make it easier to grip the closure to replace it onto the bottle and also while using the brush portion. A widened portion 29 (see FIG. 4) on the peripheral edge 19 carries the bristles. Hollow recess 29 extends downwardly to the widened portion on the peripheral edge 19. By having a hollow recess less plastic is used. However, this can be a thickened area from the peripheral edge 19 to the top 15.

Figure 4:
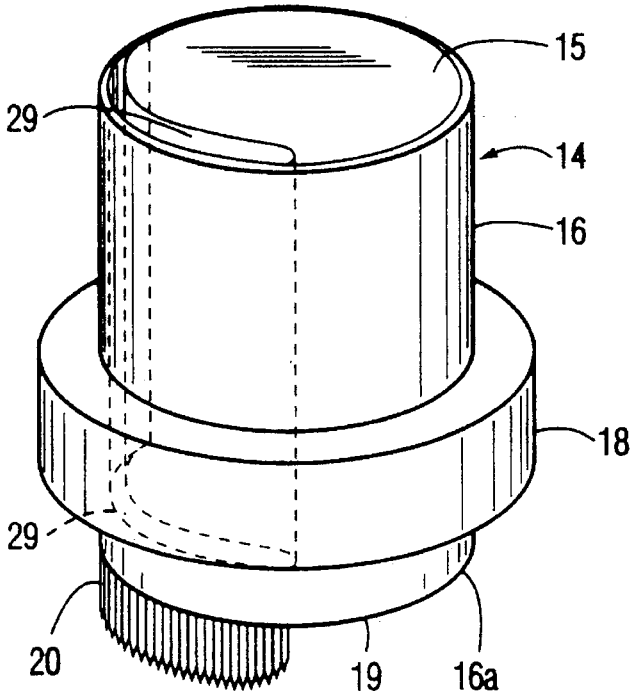
FIG. 4 shows a closure with bristles on a substantial portion of the peripheral edge.

FIG. 4 is a perspective view of the closure of FIG. 1. This shows the closure as it would be used as a brush. The peripheral edge 19 of the measuring cup is shown in this view.

Figure 5:
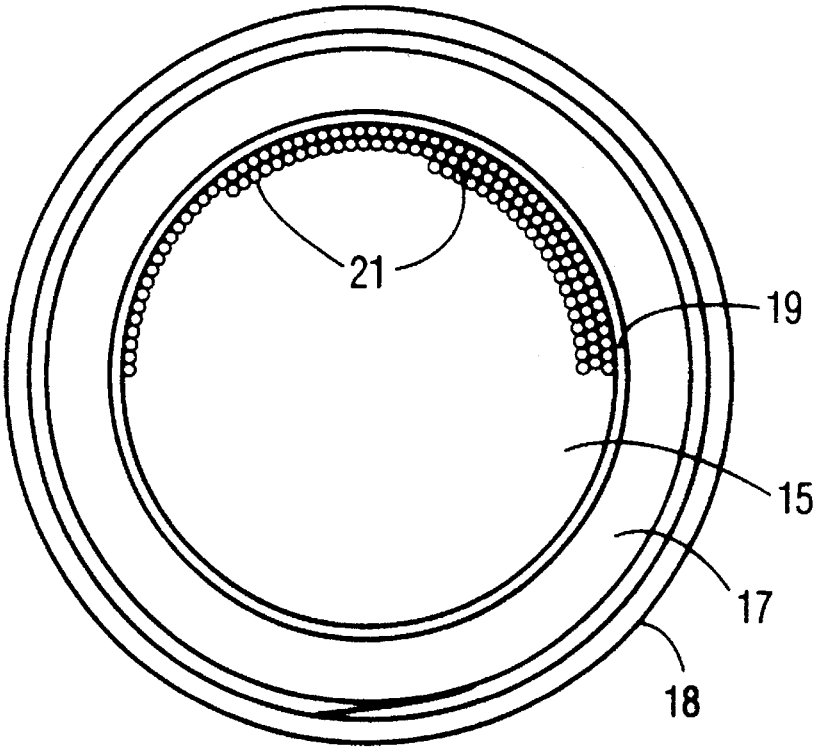
FIG. 5 is a bottom plan view of the closure of FIG. 4.

FIG. 5 is a bottom plan view of the closure of FIG. 4. This shows the bristles 21 on a widened portion 19(*a*) of peripheral edge 19.

Figure 6:
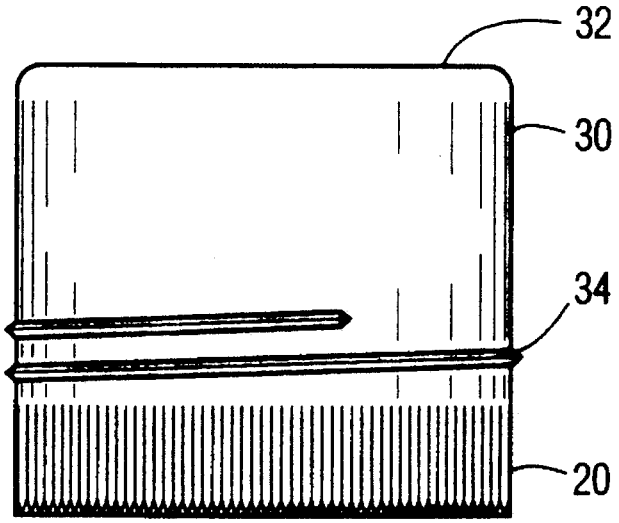
FIG. 6 is a perspective view of a closure to be attached to a bottle having inner threads in the neck.

FIG. 6 is a perspective view of the closure where there is no second skirt. There is an upper surface 32 with a depending skirt 30. Threads 34 on skirt 30 will mate with threads on the interior of the exit of a bottle. Bristles 20 can be formed by serrating the lower edge of skirt 30.

Figure 7:
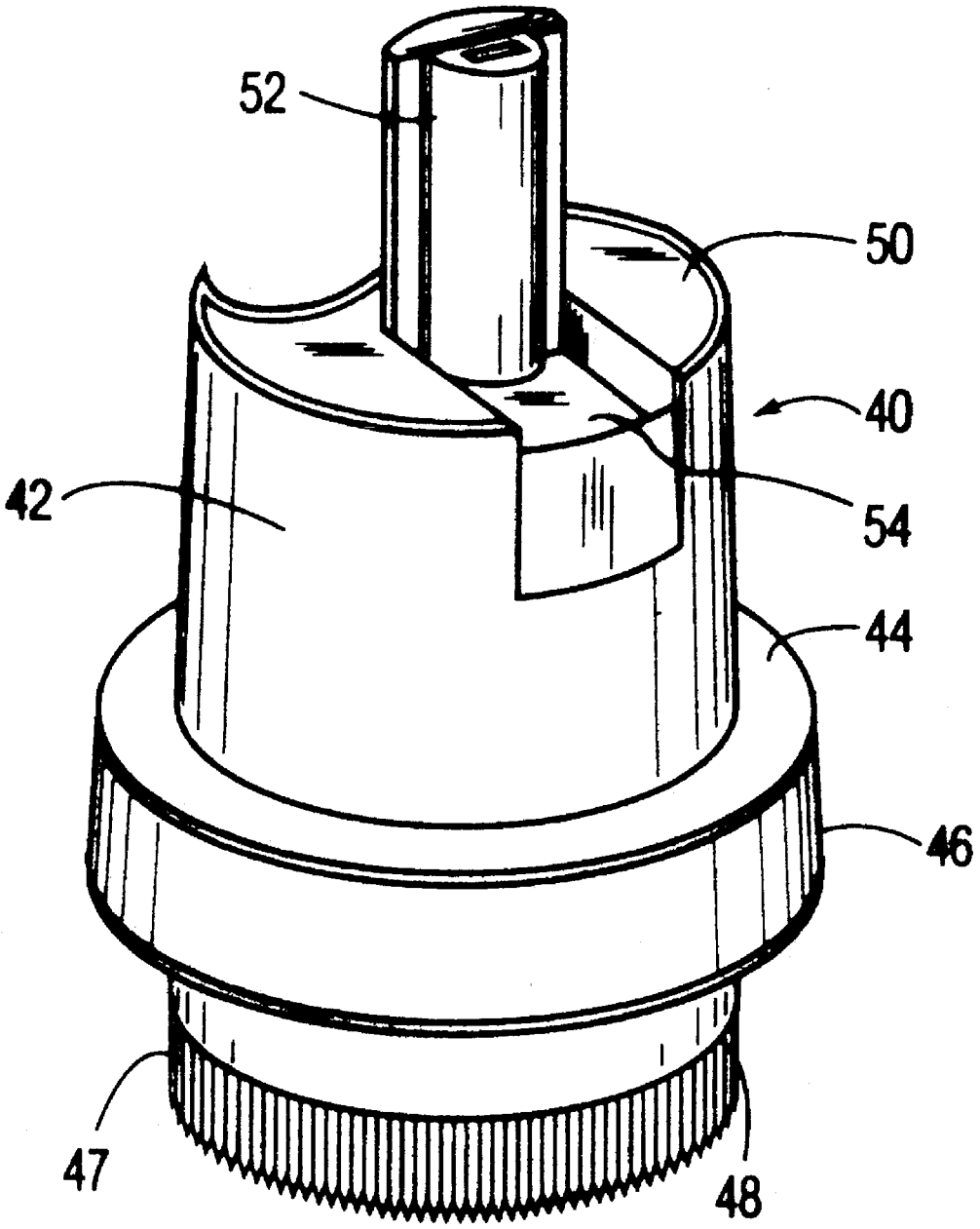
FIG. 7 is a perspective view of the closure with a delivery spout.

In FIG. 7 there is shown a closure which in addition to having bristles on the lower peripheral edge of the measuring cup portion of the closure has a delivery spout on the upper surface. The spout is shown in the open position. This consists of closure 40 with cup portion 42. Flange 44 supports skirt 46 which has threads on the inner surface for attaching to a container. Measuring cup edge 48 has depending bristles 47. On the upper surface 50 of the closure, which is the bottom of the measuring cup, there is a spout 52. This spout is shown as being of a flip open type. In the closed position this spout fits down into recess 54. In this embodiment a small amount of product can be applied to a fabric through this spout. The spout is then closed and the closure removed from the container. The product can then be brushed into a fabric and the closure put back onto the container. This closure provides a convenient way to apply pre-spot compositions to a fabric.

The closure can be formed using essentially any thermoplastic. Suitable thermoplastics are polyethylenes and polypropylenes. The closure can be formed by injection molding.

A key feature of this invention is that a pre-spot can be readily applied to a fabric using the closure to apply the pre-spot to the fabric and to work the pre-spot into the fabric. There is convenience with a persons hands not contacting the product and further the container not being coated with any of the product during use.

The present invention has been disclosed with reference to the more preferred embodiments. The broad concept is the incorporation of bristles onto the lower peripheral edge of the measuring cup of a measuring cup closure.

We claim:

1. A closure for a bottle comprising an upper surface, said upper surface having a periphery, a first skirt having a lower edge and depending from said periphery of said upper surface to form an enclosed volume, attachment means to attach said closure to a bottle exit, and bristles depending from at least a portion of the lower edge of said first skirt.

2. A closure as in claim 1 wherein there is a second skirt, said second skirt being spaced outwardly from said first skirt and having thereon said attachment means.

3. A closure as in claim 2 wherein a portion of said lower edge of said first skirt is free of bristles.

4. A closure as in claim 2 wherein said bristles are an integral part of said first skirt.

5. A closure as in claim 2 wherein said attachment means comprises threads.

6. A closure as in claim 5 wherein said threads are on an inner surface of said second skirt.

7. A closure as in claim 2 wherein said first skid has an indent in one portion thereof to form a grip.

8. A closure as in claim 2 wherein said first skirt has a thickened portion, said thickened portion having bristles thereon.

9. A closure as in claim 1 wherein there are threads on the outer surface of said first skirt adjacent said lower edge.

10. A closure as in claim 1 wherein an openable spout is located on said upper surface.

11. A bottle and closure, said bottle having a containment portion and an exit portion, said exit portion having a closure thereon said closure comprising an upper surface, said upper surface having a periphery, a first skirt having a lower edge and depending from said periphery of said upper surface to form an enclosed volume, attachment means to attach said closure to a bottle exit, and bristles depending from at least a portion of the lower edge of said first skirt.

12. A bottle and closure as in claim 11, wherein said closure has a second skirt, said second skirt spaced outwardly from said first skirt, and having thereon said attachment means.

13. A bottle and closure as in claim 11, wherein on said closure a portion of said lower edge of said first skirt is free of bristles.

14. A bottle and closure as in claim 11, wherein on said closure said bristles are an integral part of said first skirt.

15. A bottle and closure as in claim 11, wherein said attachment means comprises threads.

16. A bottle and closure as in claim 11, wherein on said closure said threads are on an inner surface of said second skirt.

17. A bottle and closure as in claim 11, wherein on said closure said first skirt has an indent in one portion thereof to form a grip.

18. A bottle and closure as in claim 11, wherein on said closure said first skirt has a thickened portion, said thickened portion having bristles thereon.

19. A bottle and closure as in claim 11, wherein said bottle has a spout extending from said exit portion, said spout contained within said first skirt when said closure is on said bottle.

20. A bottle and closure as in claim 12, wherein said bottle has a spout extending from said exit portion, said spout contained within said first skirt when said closure is on said bottle.

21. A bottle and closure as in claim 11, wherein there are threads on the outer surface of said first skirt adjacent said lower edge.

22. A bottle and closure as in claim 11, wherein an openable spout is located on the upper surface of said closure.

* * * * *